US008590434B2

(12) United States Patent
Lai

(10) Patent No.: US 8,590,434 B2
(45) Date of Patent: Nov. 26, 2013

(54) HAND TOOL TORSION ADJUSTMENT STRUCTURE

(76) Inventor: Jin-Tsai Lai, Taichung (TW)

( * ) Notice: Subject to any disclaimer, the term of this patent is extended or adjusted under 35 U.S.C. 154(b) by 156 days.

(21) Appl. No.: 13/354,313

(22) Filed: Jan. 19, 2012

(65) Prior Publication Data

US 2012/0210832 A1 Aug. 23, 2012

(30) Foreign Application Priority Data

Feb. 18, 2011 (TW) ..... 100203032 U

(51) Int. Cl.
*B25B 23/143* (2006.01)

(52) U.S. Cl.
USPC ..... 81/475; 81/467; 81/473

(58) Field of Classification Search
USPC ..... 81/467–483; 73/862–862.24; 74/567; 173/178
See application file for complete search history.

(56) References Cited

U.S. PATENT DOCUMENTS 2,176,928 A * 10/1939 Short ..... 81/475
2009/0260490 A1 * 10/2009 Cutler et al. ..... 81/475

* cited by examiner

*Primary Examiner* — Monica Carter
*Assistant Examiner* — Melanie Alexander

(57) ABSTRACT

A hand tool torsion adjustment structure includes a main mechanism, a torsion release mechanism and a micro-adjustment mechanism. The main mechanism is composed of a working rod and a tool handle while the torsion release mechanism is provided with a first engage tooth, a second engage tooth and a spring, and the micro-adjustment mechanism consists of a resisting member, an interacting member and at least one adjusting pinion. The torsion value of the hand tool can quickly be adjusted through the main mechanism and the torsion release mechanism, and the torsion preset value of the hand tool can precisely be fine-adjusted via the micro-adjustment mechanism.

5 Claims, 6 Drawing Sheets

HAND TOOL TORSION ADJUSTMENT STRUCTURE

BACKGROUND OF THE INVENTION

1. Field of the Invention

This invention relates to a hand tool torsion adjusting structure, particularly to one provided with a main mechanism and a torsion release mechanism that are able to quickly adjust the torsion value of a hand tool, and a micro-adjustment mechanism that can further carry out fine adjustment for the torsion preset value with great precision.

2. Description of the Prior Art

As commonly known, hand tools are requisite tools frequently seen and used in a family and in a factory and among the hand tools, screwdrivers are employed most widely. In recent years, hand tools inside the country have developed quickly and fully, and whether the variety or the quality of structure of the hand tools has led the trend. Therefore, hand tools easy to be operated or having function of humanization have come out one after another in order to let consumers use the hand tools with great convenience.

A conventional hand tool, as disclosed in a Taiwanese patented patent, application no. 096200374 (also known as publication no.: M316778, titled "Screwdriver Tool With Two Adjustment Torsion Value", includes a main body having its interior orderly formed with a guide space and an accommodating space. The guide space is transversely bored with two viewing windows at proper locations of two sides, and the main body has one end locked with a sealing cover with a central insert portion and another end bored with an insert hole. A torsion adjustment device straight assembled in the guide space of the main body is composed of an adjusting member, an adjusted member, an elastic member and a driving member. The adjusting member has an adjusting section inserted through the sealing cover of the main body and threadably combined with the adjusted member, and a compression space is formed between the adjusted member and the driving member for receiving the elastic member. The adjusted member is provided with two marking surfaces respectively corresponding with the two viewing windows of the main body, and the driving member has another end disposed with a driving portion. A transmission device, which is a steering device, is received in the accommodating space of the main body, consisting of an interaction member and a transmission member. The transmission member has a preset location annularly provided with a rotary surface able to move axially in the insert hole of the main body and has a location opposite to the end of the driving member arranged with an interaction portion. The interaction member is coupled between the interaction portion of the transmission member and the driving portion of the driving member, while the transmission member has another end formed with a driving end for driving and locking articles.

The conventional hand tool torsion adjustment structure mentioned above is only marked with two kinds of torsion value graduations, but is by no means two kinds of torsion adjustment modes. Although the conventional hand tool has a function of carrying out torsion adjustment, yet on the whole, it is not easy to adjust the torsion of the conventional hand tool with precision because, during torsion adjustment, a spanner is employed to turn around the central portion of the adjusting member to threadably move and push the adjusting member for changing the bearing value of the torsion. Substantially, it is difficult to correctly control a torsion value required in a way of turning around the central portion of the adjusting member and also hard to carry out fine adjustment of the torsion value with precision.

SUMMARY OF THE INVENTION

The objective of this invention is to offer a hand tool torsion adjustment structure, able to quickly adjust the torsion value of the hand tool through a main mechanism and a torsion release mechanism and also able to further precisely carry out fine adjustment for the torsion preset value of the hand tool via a micro-adjustment mechanism.

The hand tool torsion adjustment structure in the present invention includes a main mechanism, a torsion release mechanism and a micro-adjustment mechanism. The main mechanism consists of a working rod and a tool handle having an interior formed with an accommodating space for receiving the working rod, the torsion release mechanism and the micro-adjustment mechanism. The working rod is formed with a working head and a combination end positioned in the interior of the tool handle, and the torsion release mechanism is coupled with the combination end. The maximum torsion bearing value of the working rod can be changed by different extents that the micro-adjustment mechanism pushes against the torsion release mechanism. The micro-adjustment mechanism is composed of a resisting member, an interacting member and at least one adjusting pinion. The accommodating space of the tool handle is formed with female threads, while the resisting member has an outer surface formed with male threads to be engaged with the female threads to enable the resisting member to be rotated and shifted for releasing or resisting against the torsion release mechanism. The resisting member has a shaft center portion bored with a polygonal hole for the interacting member to be inserted therein, and the interacting member has one end formed with a polygonal rod to be inserted in the polygonal hole and another end provided with a torus gear to be engaged with the adjusting pinion, the torus gear being larger than the adjusting pinion in diameter. Further, the interacting member has a shaft center portion bored with a first polygonal adjusting hole exposed to the tail of the tool handle, and the adjusting pinion is bored with a second polygonal adjusting hole also exposed to the tail of the tool handle. Thus, the interacting member can be rotated through either the first polygonal adjusting hole or the second polygonal adjusting hole and synchronously, the resisting member will be actuated by the interacting member to rotate and shift for releasing or pushing the torsion release mechanism. Turning around the first polygonal adjusting hole in the shaft center of the interacting member can quickly adjust the torsion of the hand tool, and operating the second polygonal adjusting hole of the adjusting pinion to actuate the big torus gear can carry out fine adjustment for the torsion of the hand tool.

Further, the tool handle has its tail provided with a rotatable receiving seat for receiving both the interacting member and the adjusting pinion, and the receiving seat has its outer end mounted thereon with a cover member, an interacting pinion and a swing member. The cover member is covered on the end of the interacting member and has one side opposite to the interacting member formed with an annular projection having its center communicating with the first polygonal adjusting hole. The interacting pinion is engaged with the torus gear. The swing member has one end formed with a retainer to be fitted around the outer edge of the annular projection of the cover member and another end formed with an L-shaped cover plate for partially covering the end of the receiving seat. The L-shaped cover plate has an inner side disposed with an inner annular rack to be engaged with the interacting pinion and is marked thereon with graduations.

Furthermore, the tool handle is provided with a rear sheath to be covered on the tail. The rear sheath has one end assembled with a protective plate that is bored with a first hole communicating with the first polygonal adjusting hole and a second hole communicating with the second polygonal adjusting hole and provided with a lens at a location corresponding with a portion of the L-shaped cover plate where graduations are marked.

The torsion release mechanism is composed of a first engage tooth, a second engage tooth and a spring. The first engage tooth has one end pushing against the resisting member and another end unidirectionally and clockwise engaged with the second engage tooth. The second engage tooth is bored with a polygonal hole for receiving the working rod therein, and the working rod has its combination end formed with a polygonal rod section to be inserted in the polygonal hole. The spring is fitted around the working rod, having one end pushing against the second engage tooth and another end resisting an inner side of the tool handle.

In addition, the tool handle is provided with a front sheath to be mounted on the front end, and the working rod is formed with an annular recess at a location corresponding with the front sheath of the tool handle. The front sheath has its inner side fixed with limiting ribs to be stretched in the annular recess for stopping the working rod form slipping off the tool handle.

To sum up, the hand tool torsion adjustment structure in the present invention is a device of practicability and progressiveness and is well worthy of being popularized.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
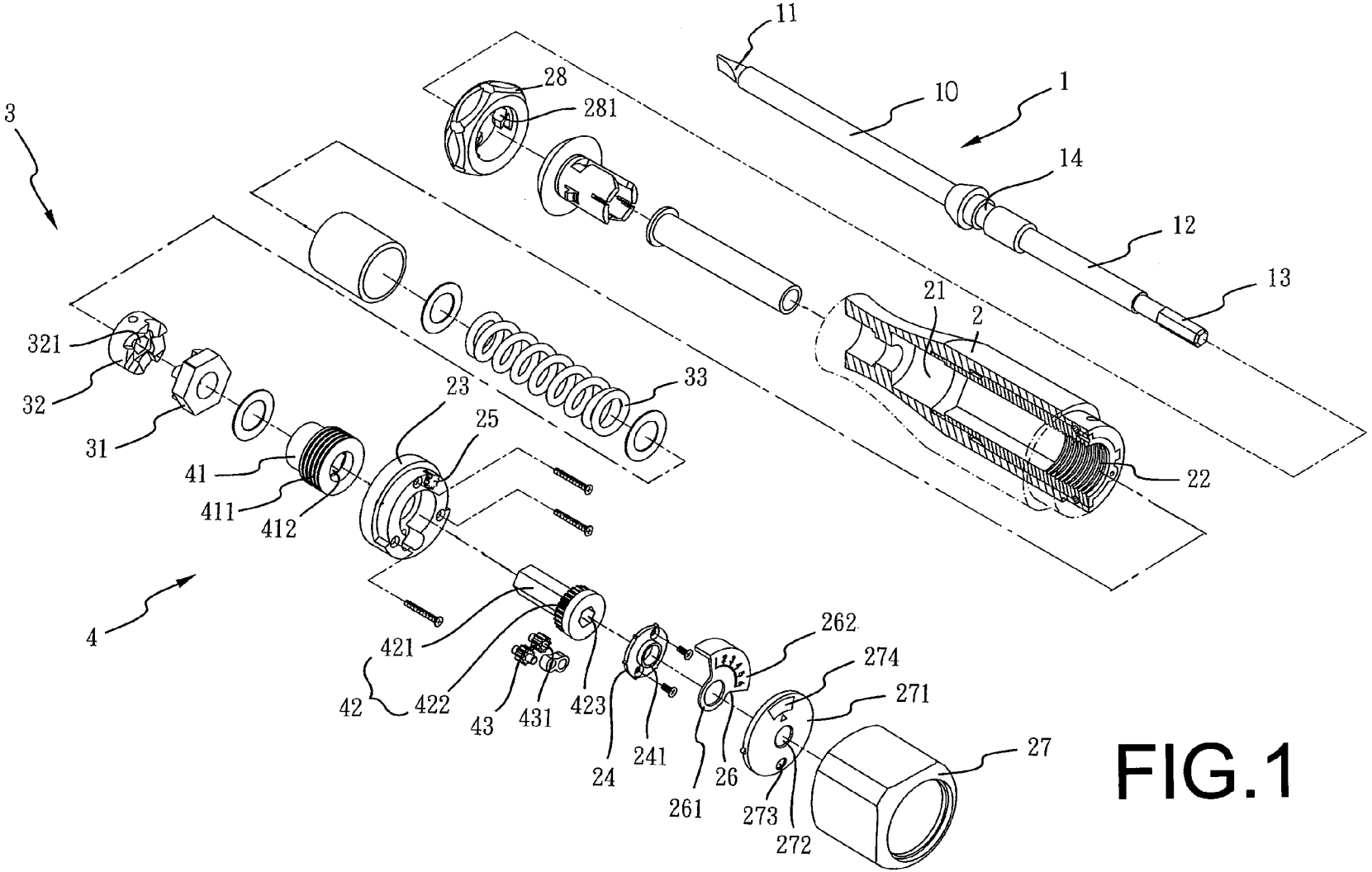
FIG. 1 is an exploded perspective view of a hand tool torsion adjustment structure in the present invention.
Figures 2, 3:
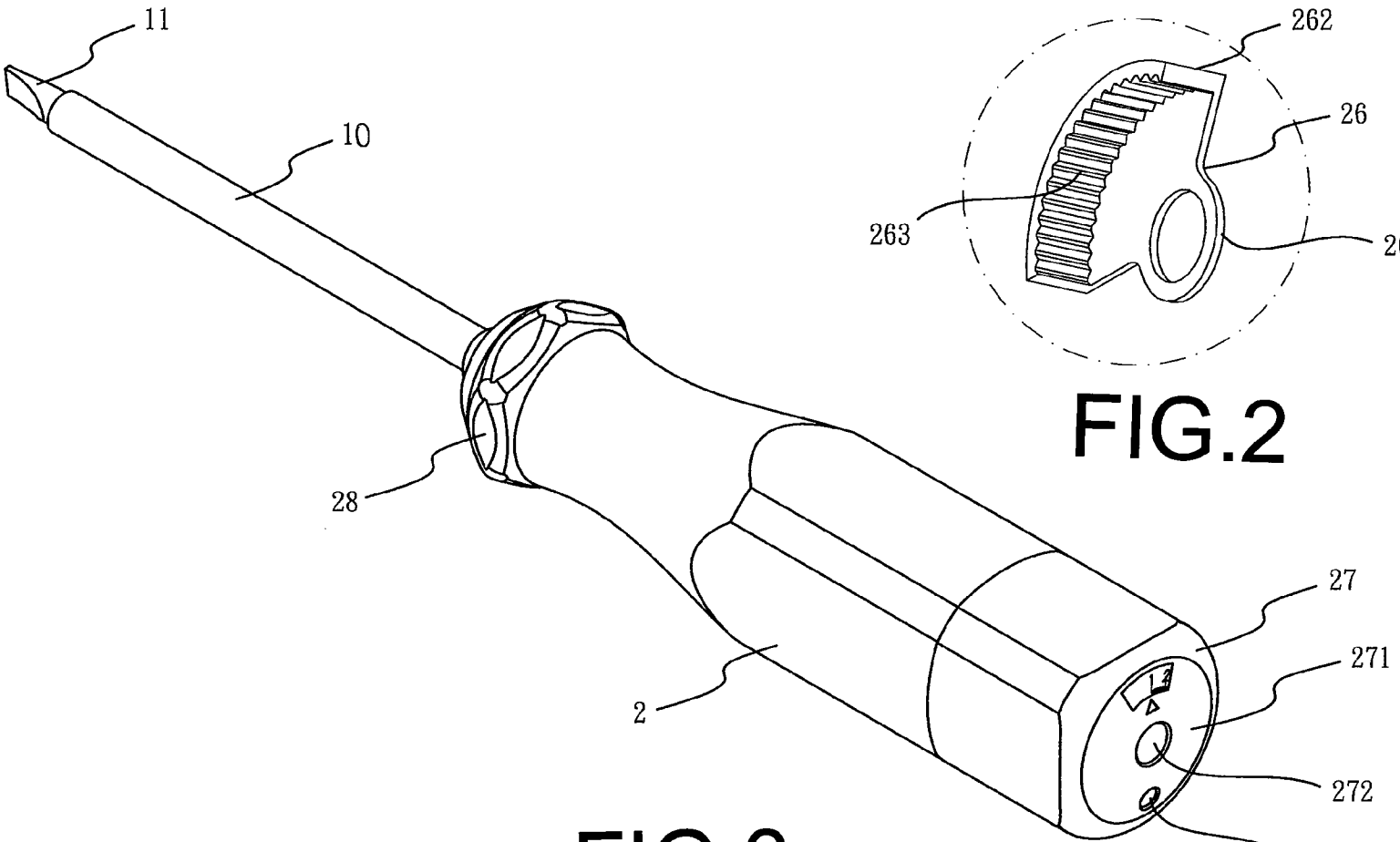
FIG. 2 is a perspective view of a swing member viewed from one angle in the present invention.
FIG. 3 is a perspective view of a hand tool torsion adjustment structure in the present invention.

A preferred embodiment of a hand tool torsion adjustment structure in the present invention, as shown in FIGS. 1-7, includes a main mechanism 1, a torsion release mechanism 3 and a micro-adjustment mechanism 4 as main components combined together. The torsion value of a hand tool can quickly be adjusted through the main mechanism 1 and the torsion release mechanism 3 while the micro-adjustment mechanism 4 can further carry out fine adjustment for the torsion value preset.

The maim mechanism 1 consists of a working rod 10 and a tool handle 2 that has an interior formed with an accommodating space 21 for receiving the working rod 10, the torsion release mechanism 3 and the micro-adjustment mechanism 4. The working rod 10 is provided with a working head 11 and a combination end 12 positioned in the interior of the tool handle 2. The torsion release mechanism 3 is coupled with the combination end 12 of the working rod 10 and pushed by the micro-adjustment mechanism 4, and different extents that the micro-adjustment mechanism 4 pushes against the torsion release mechanism 3 will change the maximum torsion bearing value of the working rod 10.

Figure 4:
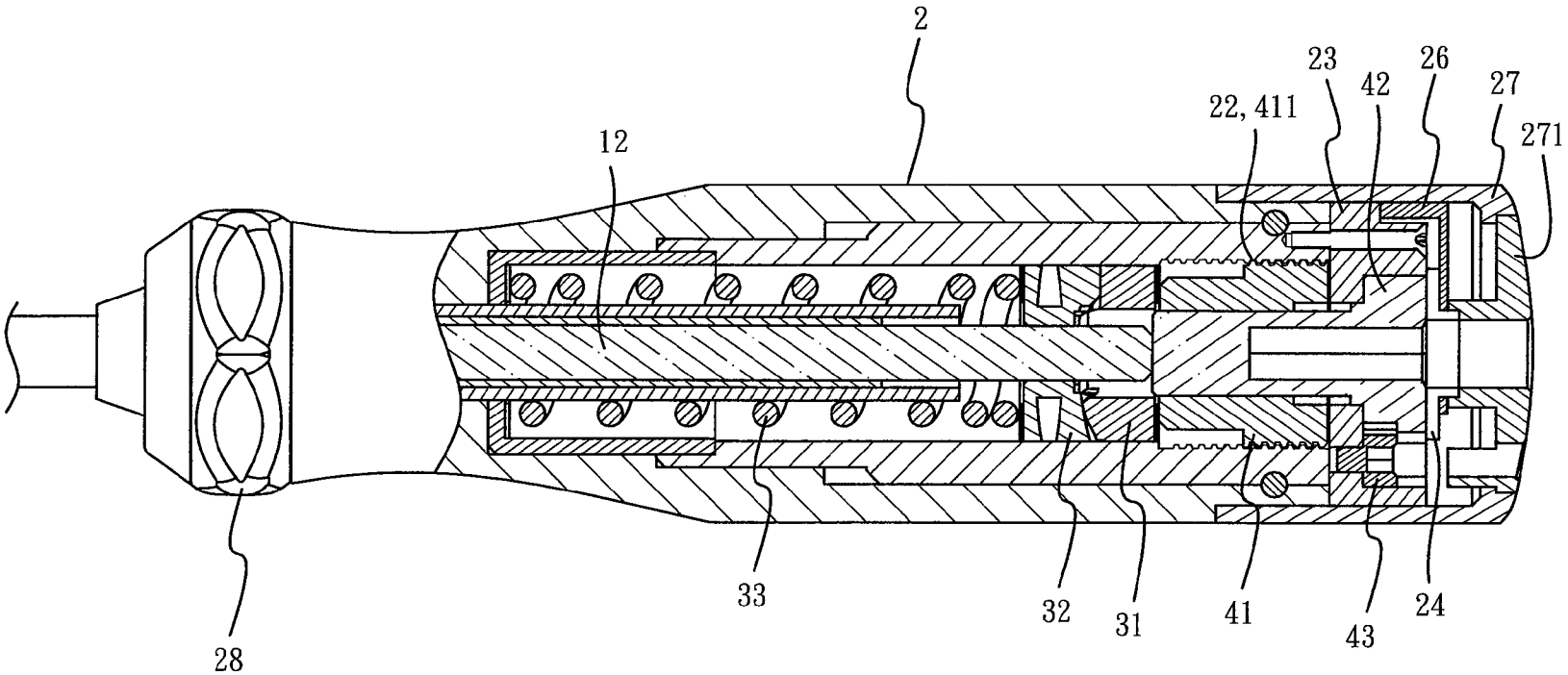
FIG. 4 and FIG. 5 are cross-sectional views of the hand tool in the present invention, illustrating that a micro-adjustment mechanism and a torsion release mechanism resist against each other in different status.
Figure 5:
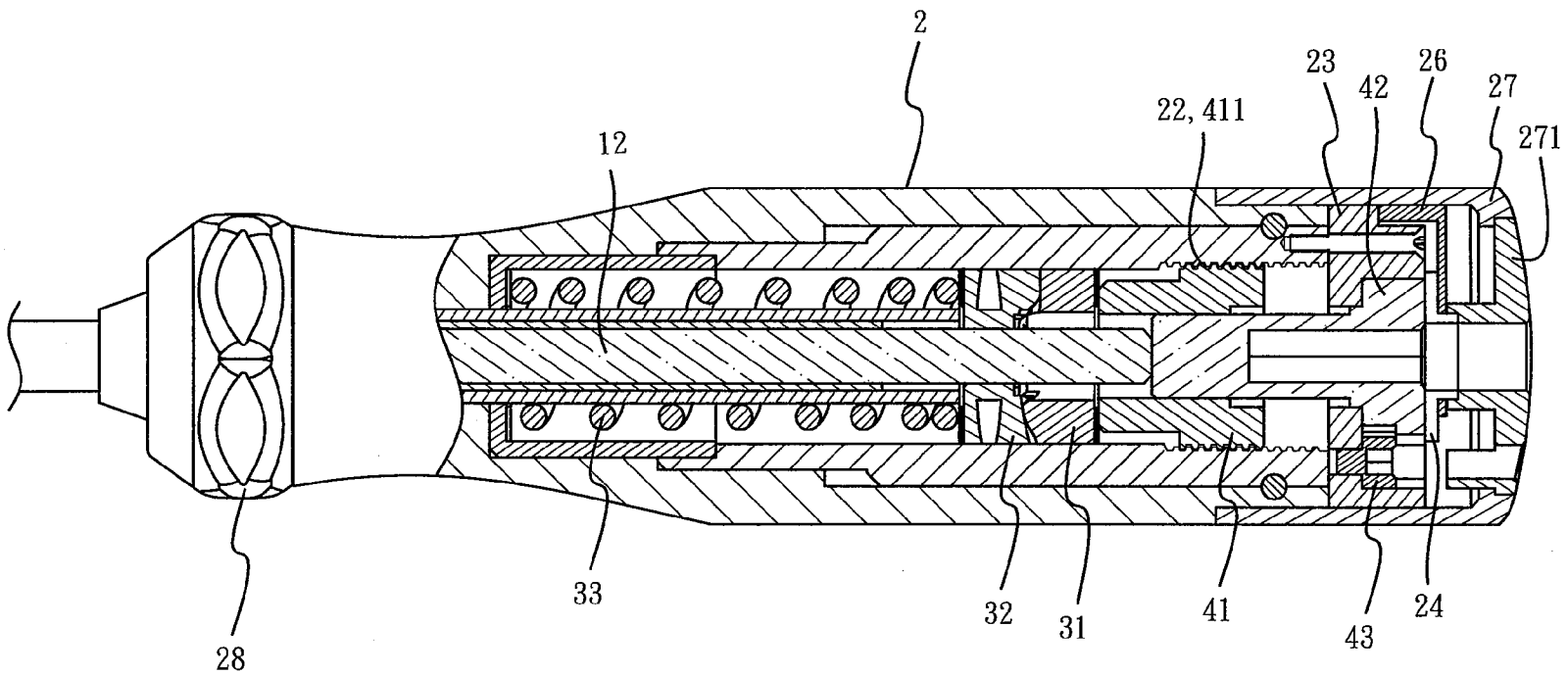

The micro-adjustment mechanism 4 is composed of a resisting member 41, an interacting member 42 and at least one adjusting pinion 43. In this preferred embodiment, two adjusting pinions 43 are coupled together. The accommodating space 21 of the tool handle 2 is formed with female threads 22, and the resisting member 41 has an outer surface formed with male threads 411 to be engaged with the female threads 22 so that the resisting member 41 can be actuated to rotate and shift for releasing or resisting the torsion release mechanism 3. The resisting member 41 has a shaft center portion bored with a polygonal hole 412 for the interacting member 42 to be inserted therein, and the interacting member 42 has one end provided with a polygonal rod 421 to be inserted in the polygonal hole 412 of the resisting member 41 and another end disposed with a torus gear 422 to be engaged with the adjusting pinions 43, with the diameter of the torus gear 422 being larger than that of the adjusting pinion 43. Further, the interacting member 42 has its shaft center portion bored with a first polygonal adjusting hole 423 exposed to the tail of the tool handle 2, and the adjusting pinions 43 are bored with a second polygonal adjusting hole 431 exposed to the tail of the tool handle 2. Thus, the interacting member 42 can be rotated through either the first polygonal adjusting hole 423 or the second polygonal adjusting hole 431 and synchronously, the resisting member 41 will be driven by the interacting member 42 to rotate and shift for releasing or pushing against the torsion release mechanism 3, as shown in FIGS. 4 and 5. Turning around the first polygonal adjusting hole 423 in the shaft center of the interacting member 42 can quickly adjust the torsion of the hand tool, while operating the second polygonal adjusting hole 431 to have the pinion gear 43 actuating the big torus gear 422 can carry out fine adjustment for the torsion of the hand tool.

Figure 6:
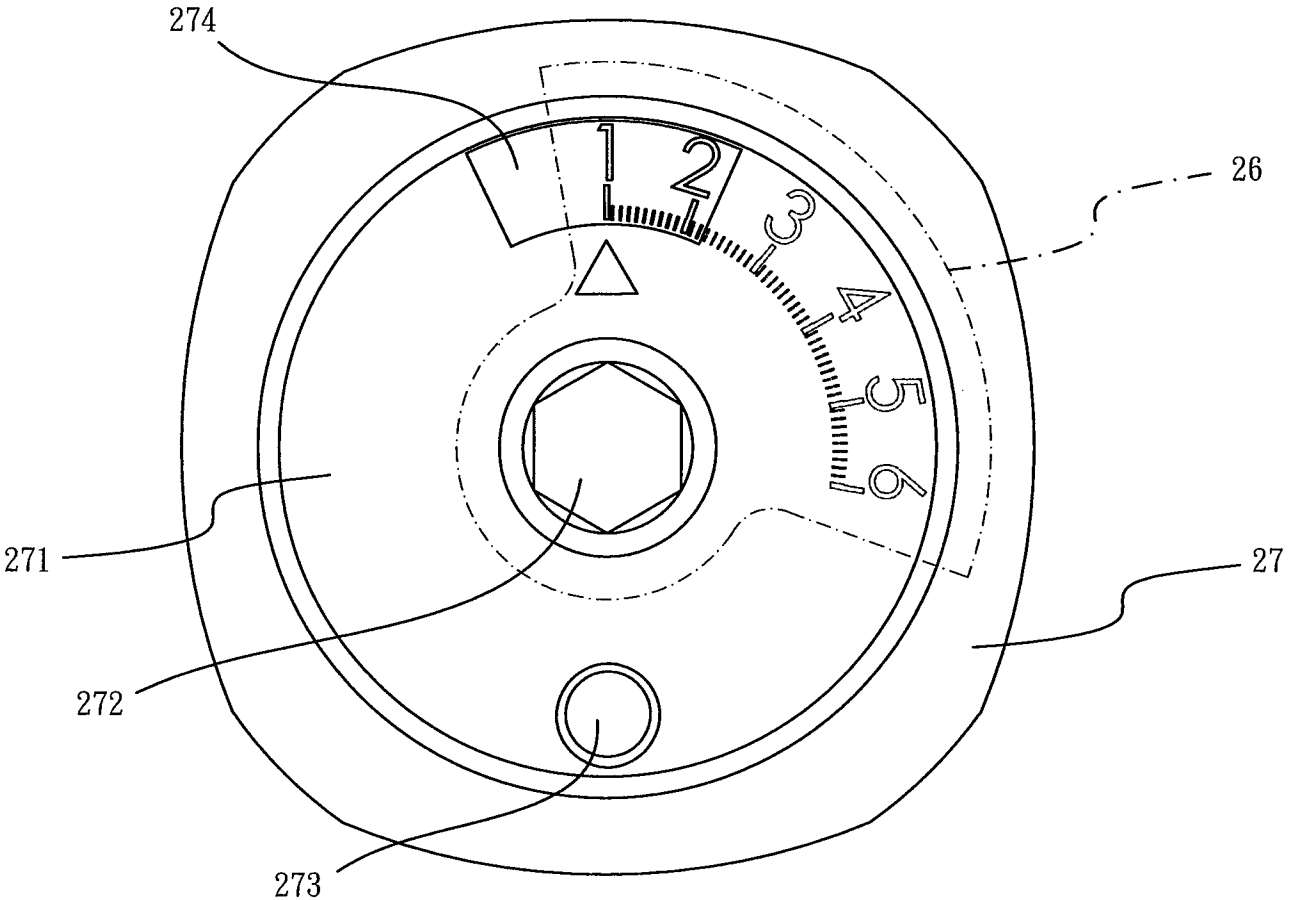
FIG. 6 and FIG. 7 are schematic views illustrating that different torsion values are presented after an L-shaped cover plate is adjusted.
Figure 7:
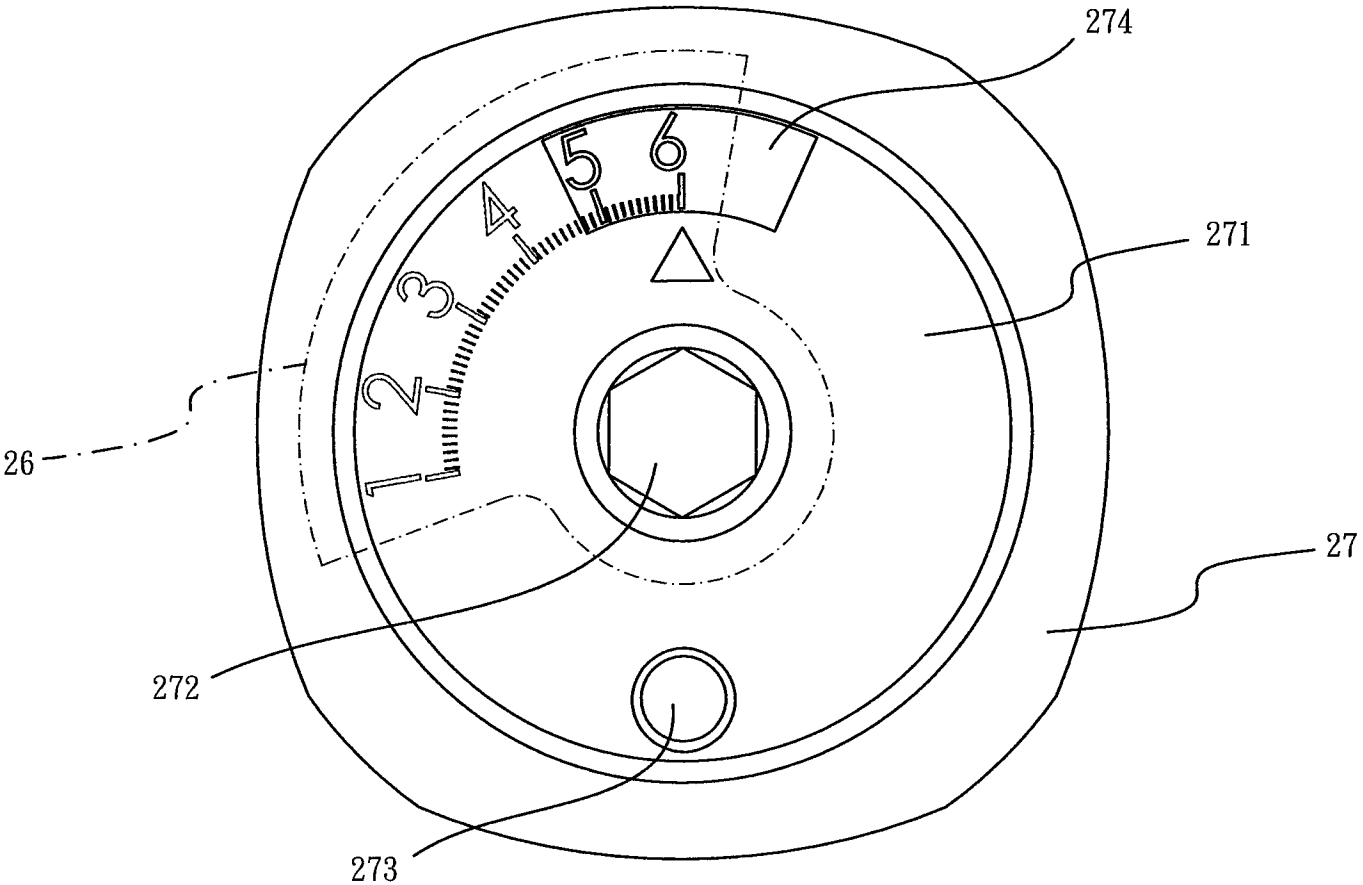

Further, the tool handle 2 has its tail provided with a rotatable receiving seat 23 for receiving the interacting member 42 and the adjusting pinions 43. The receiving seat 23 has its outer end disposed with a cover 24, an interacting pinion 25 and a swing member 26. The cover 24 is covered on the end of the interacting member 42 and has one side opposite to the interacting member 42 formed with an annular projection 241 having a central portion communicating with the first polygonal adjusting hole 423. The interacting pinion 25 is engaged with the torus gear 422, and the swing member 26 has one end formed with a retainer 261 to be fitted around the outer edge of the annular projection 241 and another end provided with an L-shaped cover plate 262 to be covered on partial end of the receiving seat 23. The L-shaped cover plate 262 of the swing member 26 has its inner side disposed with an inner annular rack 263 to be engaged with the interacting pinion 25 and is marked thereon with graduations. Thus, when the interacting member 42 is rotated, the torus gear 422 engaged with the interacting pinion 25 will be rotated together and synchronously, the inner annular rack 263 engaged with the interacting pinion 25 will be actuated to rotate and make the swing member 26 to swing pivotally with the annular projection 241 acting as a pivot and indicate the torsion value index for the time being, as shown in FIGS. 6 and 7.

Furthermore, the tool handle 2 is provided with a rear sheath 27 for covering the tail. The rear sheath 27 has an and assembled with a projective plate 271, which is bored with a first hole 272 communicating with the first polygonal adjusting hole 423, and a second hole 273 communicating with the second polygonal adjusting hole 431. The protective plate 271 is further provided with a lens 271 at a location corresponding with a portion of the L-shaped cover plate 262 where graduations are marked and thus the numerical value indicated on the L-shaped cover plate 202 can be seen through the lens 274. In addition, the protective plate 271 can be marked with index at a location adjacent to the lens 274.

The torsion release mechanism 3 contains a first engage tooth 31, a second engage tooth 32 and a spring 33. The first engage tooth 31 has one end pushing against the resisting member 41 and another end unidirectionally and clockwise engaged with the second engage tooth 32. (So-called unidirectional and clockwise engagement means that two gears are respectively formed with a slant and a perpendicular corresponding tooth surface. When they are rotated clockwise, tooth skipping may happen according to different relative resisting forces of the slant corresponding tooth surfaces, and when they are rotated reversely, the perpendicular corresponding tooth surfaces will be meshed together and tooth skipping is impossible to happen. This is a well-known art, not to be described its detail.) The second engage tooth 32 is bored with a polygonal hole 321 for the working rod 10 to be inserted therein. The working rod 10 has its combination end formed with a polygonal rod section 13 to be received in the polygonal hole 321. The spring 33 is fitted on the working rod 10, having one end resisting against the second engage tooth 32 and another end pushing against the inner side of the tool handle 2. Thus, when the resisting member 41 is driven to shift and push against the first engage tooth 31 and the second engage tooth 32, the compressed extent of the spring 33 can be adjusted and simultaneously, the bearable torsion value of the working rod 10 that is rotated together with the second engage tooth 32 will be changed by the compressed spring 33.

Moreover, the tool handle 2 has its front end mounted with a front sheath 28, and the working rod 10 is formed with a circular recess 14 at a location corresponding with the front sheath 28. The front sheath 28 has its inner side provided with limiting ribs 281 to be stretched in the circular recess 14 for stopping the working rod 10 from slipping off the tool handle 2 and thus, the working rod 10 restricted by the limiting ribs 281 can be rotated only relatively to the tool handle 2.

While the preferred embodiment of the invention has been described above, it will be recognized and understood that various modifications may be made therein and the appended claims are intended to cover all such modifications that may fall within the spirit and scope of the invention.

What is claimed is:

1. A hand tool torsion adjustment structure comprising a main mechanism, a torsion release mechanism and a micro-adjustment mechanism;

said main mechanism provided with a working rod and a tool handle, said tool handle formed with an accommodating space in the interior for receiving said working rod, said torsion release mechanism and said micro-adjustment mechanism, said working rod formed with a working head and a combination end to be positioned in said tool handle;

said torsion release mechanism coupled with said combination end, a maximum torsion bearing value of said working rod able to be changed by different extents that said micro-adjustment mechanism pushes against said torsion release mechanism, and said micro-adjustment mechanism composed of a resisting member, an interacting member and at least one adjusting pinion, said accommodating space of said tool handle formed with female threads, said resisting member having an outer surface provided with male threads to be engaged with said female threads to enable said resisting member to be rotated and shifted for releasing or pushing against said torsion release mechanism, said resisting member having a shaft center portion bored with a polygonal hole for said interacting member to be inserted therein, said interacting member having one end disposed with a polygonal rod to be inserted in said polygonal hole, said interacting member having another end formed with a torus gear to be engaged with said adjusting pinion, said torus gear being larger than said adjusting pinion in diameter, said interacting member having a shaft center portion bored with a first polygonal adjusting hole exposed to a tail of said tool handle, said adjusting pinion formed with a second polygonal adjusting hole exposed to the tail of said tool handle.

2. The hand tool torsion adjustment structure as claimed in claim 1, wherein said tool handle has a tail provided with a rotatable receiving seat for receiving said interacting member and said adjusting pinion, said rotatable receiving seat having an outer end disposed with a cover member, an interacting pinion and a swing member, said cover member covered on one end of said interacting member, said cover member having one side opposite to said interacting member formed with an annular projection, said annular projection having a central portion communicating with said first polygonal adjusting hole, said interacting pinion engaged with said torus gear, said swing member having one end provided with a retainer to be fitted around the outer edge of said torus gear, said swing member having another end formed with an L-shaped cover plate for partially covering one end of said receiving seat, said L-shaped cover plate having an inner side disposed with an inner annular rack to be engaged with said interacting pinion, said L-shaped cover plate of said swing member marked thereon with graduations.

3. The hand tool torsion adjustment structure as claimed in claim 2, wherein said tool handle is provided with a rear sheath to be covered on the tail, said rear sheath having an end mounted with a protective plate, said projective plate bored with a first hole communicating with said first polygonal adjusting hole and a second hole communicating with said second polygonal adjusting hole, said protective plate further provided with a lens at a location corresponding with a portion of said L-shaped cover plate where graduations are marked.

4. The handle tool torsion adjustment structure as claimed in claim 1, wherein said torsion release mechanism is composed of a first engage tooth, a second engage tooth and a spring, said first engage tooth having one end pushing against said resisting member and another end unidirectionally and clockwise engaged with said second engage tooth, said second engage tooth bored with a polygonal hole for said working rod to be inserted therein, said combination end of said working rod formed with a polygonal rod section to be inserted in said polygonal hole, said spring fitted around said working rod, said spring having one end pushing against said second engage tooth and another end resisting an inner side of said tool handle.

5. The hand tool torsion adjustment structure as claimed in claim 1, wherein said tool handle is provided with a front sheath to be mounted on a front end, and said working rod is formed with an annular recess at a location corresponding with said front sheath, said front sheath having an inner side fixed with limiting ribs to be stretched in said annular recess for stopping said working rod from slipping off said tool handle.

* * * * *